US011339533B2

(12) United States Patent
Even

(10) Patent No.: US 11,339,533 B2
(45) Date of Patent: May 24, 2022

(54) CONVECTIVE HOOD FOR HEAT TREATMENT OF A CONTINUOUS STRIP

(71) Applicant: SOLARONICS S.A., Armentieres (FR)

(72) Inventor: Nicolas Even, Laventie (FR)

(73) Assignee: SOLARONICS S.A., Armentieres (FR)

( * ) Notice: Subject to any disclaimer, the term of this patent is extended or adjusted under 35 U.S.C. 154(b) by 551 days.

(21) Appl. No.: 16/331,545

(22) PCT Filed: Sep. 6, 2017

(86) PCT No.: PCT/EP2017/072280
§ 371 (c)(1),
(2) Date: Mar. 8, 2019

(87) PCT Pub. No.: WO2018/046509
PCT Pub. Date: Mar. 15, 2018

(65) Prior Publication Data

US 2019/0203419 A1 Jul. 4, 2019

(30) Foreign Application Priority Data

Sep. 8, 2016 (EP) ..... 16290168

(51) Int. Cl.
*D21F 5/00* (2006.01)
*D21F 5/18* (2006.01)
(Continued)

(52) U.S. Cl.
CPC ..... *D21F 5/002* (2013.01); *D21F 5/001* (2013.01); *D21F 5/18* (2013.01); *F26B 3/283* (2013.01); *F26B 3/305* (2013.01); *F26B 21/004* (2013.01)

(58) Field of Classification Search
CPC ..... F26B 13/10; F26B 13/104; F26B 21/004; F26B 3/283; F26B 3/305; D21F 5/001; D21F 5/002; D21F 5/18
(Continued)

(56) References Cited

U.S. PATENT DOCUMENTS 5,046,944 A * 9/1991 Smith ..... F23D 14/16 431/328
6,088,930 A 7/2000 Robin
(Continued)

FOREIGN PATENT DOCUMENTS

EP 2166299 A2 3/2010
WO 58551 A1 10/2000

OTHER PUBLICATIONS

US 6,134,809 A, 10/2000, Stipp (withdrawn)

*Primary Examiner* — Vivek K Shirsat
(74) *Attorney, Agent, or Firm* — Rothwell, Figg, Ernst & Manbeck, P.C.

(57) ABSTRACT

A convective hood for transverse installation in a system for continuous heat treatment of moving strip material comprises blowing nozzles for blowing hot gas against the moving strip in an arrangement transverse to the direction of movement of the strip material; and a first transverse suction zone for the suction of hot gas. The first transverse suction zone comprises a first transverse section and a second transverse section. The first transverse section and the second transverse section are provided at the same side downstream or upstream of the movement of the strip material from the blowing nozzles when the convective hood is installed in a system for continuous heat treatment of moving strip material. The second transverse section is provided along the line for movement of the continuous strip material between the first transverse section and the blowing nozzles. The first transverse section comprises suction open-
(Continued)

ings for suction of hot gas directly from outside the convective hood into the convective hood; the suction openings being in closed gas flow connection to a first manifold for recirculation of at least part of this hot gas to the blowing nozzles for blowing the hot gas onto the continuous strip material. The second transverse section comprises suction openings for suction of hot gas directly from outside the convective hood into the convective hood; the suction openings being in closed gas flow connection to a second manifold for exhausting 100% of this hot gas outside of the convective hood.

9 Claims, 2 Drawing Sheets

(51) Int. Cl.
*F26B 3/28* (2006.01)
*F26B 3/30* (2006.01)
*F26B 21/00* (2006.01)

(58) Field of Classification Search
USPC ..... 34/274; 431/328
See application file for complete search history.

(56) References Cited

U.S. PATENT DOCUMENTS 6,289,603 B1 9/2001 Lescanne
2008/0256818 A1* 10/2008 Lenoir ..... D21F 5/18
34/60

* cited by examiner

CONVECTIVE HOOD FOR HEAT TREATMENT OF A CONTINUOUS STRIP

TECHNICAL FIELD

The disclosure relates to a convective hood for transverse installation in a system for continuous heat treatment of moving strip material. The disclosure further relates to a continuous combined convection and infrared radiation heat treatment system comprising such convective hood. The continuous heat treatment system can be used in the processing of continuous strip material such as e.g. paper or paper board.

BACKGROUND

Continuous strips or deposits on continuous strips frequently require heat treatment. The heat treatment must often be carried out without contact in order to preserve the quality of the surface state of the strip or of the deposit on it. This applies, for example, to paper strips that have undergone a wet treatment such as the treatment to produce art paper. Systems for the continuous heat treatment of strip material that combine infrared radiation and convective heating are known. The convective heat treatment can be performed by means of a convective hood, transversely installed to the moving strip material. Systems exist that comprise gas fired infrared emitters of which the hot gas is sucked and blown back on the strip by means of blowing nozzles of convective hoods, creating a combined radiation and convective heat treatment system.

U.S. Pat. No. 6,088,930 discloses convective hoods in a convection and radiation system for the heat treatment of a strip which is moving opposite to gas fired infrared radiant elements and a number of convective hoods that comprise elements blowing hot air onto the strip. The convective hoods are separated from each other by at least one gas fired infrared radiant element. Each convective hood comprises on each side a suction element extending near to a gas fired infrared radiant element.

SUMMARY

Embodiments of the disclosure may provide a convective hood providing higher energy efficiency when used in combined convection and infrared radiation systems for heat treatment of continuous strip material. Embodiments of the disclosure may also provide a combined convection and infrared radiation system for heat treatment of continuous strip material that provides higher energy efficiency.

The first aspect of the disclosure is a convective hood for transverse installation in a system for continuous heat treatment of moving strip material. When in this document "transverse" is used, it is meant the direction transverse to the direction of movement of strip material through a heat treatment system in which the convective hood is installed. The convective hood comprises blowing nozzles for blowing hot gas against the moving strip in an arrangement transverse to the direction of movement of the strip material; and a first transverse suction zone for the suction of hot gas. The first transverse suction zone comprises a first transverse section and a second transverse section. The first transverse section and the second transverse section are provided—when the convective hood is installed in a system for continuous heat treatment of moving strip material—at the same side downstream or upstream of the movement of the strip material from the blowing nozzles. The second transverse section is provided along the line for movement of the continuous strip material between the first transverse section and the blowing nozzles. The first transverse section comprises suction openings for suction of hot gas directly from outside the convective hood into the convective hood; these suction openings are in closed gas flow connection to a first manifold for recirculation of at least part of this hot gas to the blowing nozzles for blowing the hot gas onto the continuous strip material. The second transverse section comprises suction openings for suction of hot gas directly from outside the convective hood into the convective hood; these suction openings are in closed gas flow connection to a second manifold for exhausting 100% of this hot gas outside of the convective hood.

The first transverse suction zone may comprise a first transverse section and a second transverse section. When the convective hood is used next to an infrared emitter in a combined convection and infrared heating system, the suction openings in the first transverse section may suck—by their location in the first transverse section—hot gas from at the radiant emitter into the first manifold. The suction openings in the second transverse section may be provided to suck hot gas from near the blowing nozzles of the convective hood into the second manifold. By the operation of a combined radiation and convective system, the hot gas at the radiant emitter may be warmer that the hot gas at the blowing nozzles of the convective hood, and may comprise less moisture. Therefore, the hot gas in the first manifold—that can be blown via blowing nozzle onto the strip material that is to be dried—, may be warmer and comprise less moisture than the hot gas in the second manifold, hot gas which may be evacuated out of the system. By ensuring that gas of higher temperature and with less moisture is recirculated than the gas that is evacuated, the efficiency of the system using the inventive blowing hood may be increased. In prior art convective hoods, nozzles suck gas; and the sucked gas flow is split in a flow that is recirculated in the convective drying system and in a flow that is evacuated; both flows containing gas of the same temperature and containing the same amount of moisture.

The first transverse section may be provided for suction from at a first transversal section at the moving strip material; and the second transverse section may be provided for suction from at a second transversal section at the moving strip material.

Suction openings of the first transverse section of the first transverse suction zone may be provided in a segment of the convective hood. The segment may taper—when strip material is present in a system for continuous heat treatment of moving strip material in which the convective hood is installed—between the convective hood and the strip material in the direction of the second transverse section of the suction zone of the convective hood. Such embodiment provides further improved energy efficiency due to the directed suction of warmer hot gas with less moisture content by the suction openings of the first transverse section of the first transverse suction zone. The taper angle (the angle made with the strip material) may be between 20° and 60°.

Suction openings of the second transverse section of the first transverse suction zone may be provided such that when the convective hood is used in a system for continuous heat treatment of moving strip material, the suction openings of the second transverse section may be located in a in a plane parallel with the average plane in which the strip material runs through the system.

The convective hood may comprise an individual fan, provided for the suction of hot gas by the suction nozzles of the first transverse section of the first transversal suction zone and for blowing hot gas by the blowing nozzles. Such embodiment may provide enhanced efficiency, as heat losses of sucked hot gas that is to be blown back may be minimized due to the short length of the connection between suction and blowing nozzles in the convective hood.

In between the blowing nozzles, additional suction opening may be provided for the suction of hot gas. The additional suction openings may be in flow connection with a manifold for the evacuation out of the convective hood of all gas sucked by the additional suction openings. The additional suction openings may be in flow connection with the second manifold. The additional suction openings may be in flow connection with a manifold for evacuation of hot gas out of the system in which the convective hood is used. Such embodiments may provide further synergistic improvements of energy efficiency.

At the other side of the blowing nozzles than where the first transverse suction zone is provided, a second transverse suction zone comprising suction nozzles may be provided. All suction nozzles of the second transverse suction zone may be in flow connection with a manifold for evacuation out of the convective hood of all gas sucked by the suction nozzles of the second transverse suction zone. These suction nozzles may be in flow connection with the second manifold. These suction nozzles may be in flow connection with a manifold for evacuation of hot gas out of the system in which the convective hood is used. Such embodiments may provide further synergistic improvements of energy efficiency.

The second aspect of the disclosure is a system for continuous heat treatment of moving strip material. The system may comprise a plurality of convective hoods as in any embodiment of the first aspect of the disclosure; and at least one radiant emitter may be transversally installed to the direction of movement for strip material. Two consecutive convective hoods as in any embodiment of the first aspect of the disclosure may be separated from each other in the direction of movement of the strip material by at least one radiant emitter.

At least one of the convective hoods may comprise a first transverse suction zone comprising a first transversal section and a second transversal section; the first transverse section zone may be provided in the convective hood in the upstream direction of movement of the strip material from the blowing nozzles.

The first convective hood encountered by the strip material when moving through the system may comprise a first transverse section zone, wherein the first transverse suction zone may be provided in the convective hood in the downstream direction of movement of the strip material from the blowing nozzles. Such embodiment may provide further improved energy efficiency. At the entrance of the first convective hood, the strip material may drag in cooler gas. When at the exit of the first convective hood, an infrared emitter may be installed, the suction nozzles of the first transverse section of the first transverse suction zone may suck warmer gas from at the infrared emitter; this gas may be blown back by the suction nozzles for more efficient heat treatment of the strip material.

Each of the convective hoods may comprise an individual fan. The individual fan may be provided for the suction of hot gas by the suction nozzles of the first transversal sections of the first transversal suction zone of the convective hood and for blowing hot gas by the blowing nozzles of the same convective hood.

A system may comprise a central fan for the suction of hot gas by the suction nozzles of the second transversal sections of the first transversal suction zones of the convective hoods. The central fan may be provided for blowing the hot gas sucked by it into piping for exhausting the hot gas out of the system. The central fan may be provided for suction of hot gas by the suction nozzle of the second suction zone—if present—; and for suction of hot gas by the additional suction openings—if present—, and for blowing that sucked hot gas into piping for exhausting the hot gas out of the system.

A system may comprise at both sides of the path for the movement of the strip material a plurality of convective hoods as in any embodiment of the first aspect of the disclosure; and at least one radiant emitter. Radiant emitters may be installed between consecutive convective hoods.

The radiant emitter comprises gas-fired radiant burners.

The radiant emitter comprises electrical radiant emitters.

DETAILED DESCRIPTION

Figure 1:
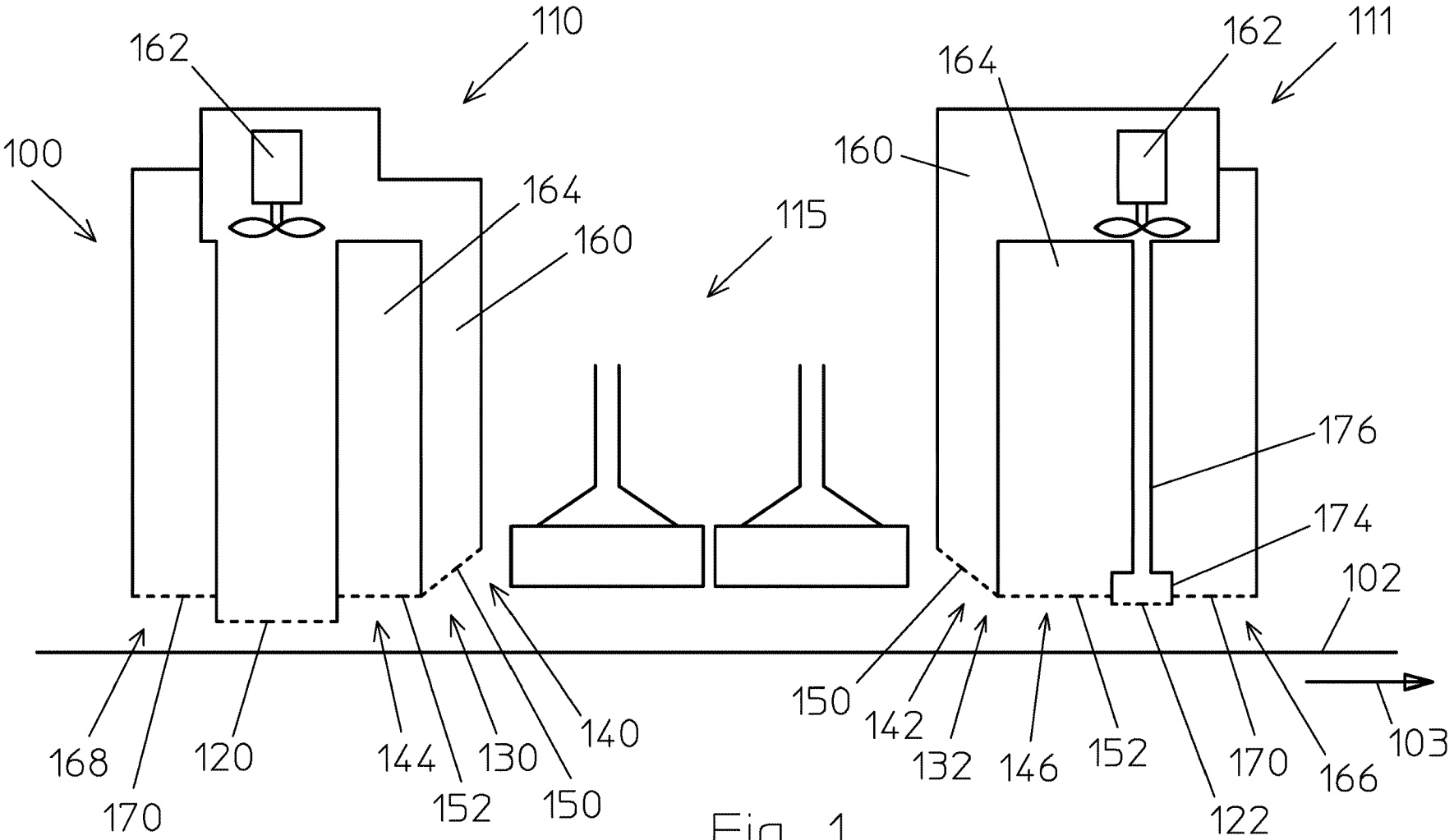
FIG. 1 shows a longitudinal cross section of a system for continuous heat treatment of moving strip material, comprising a plurality of convective hoods as in the first aspect of the disclosure.

FIG. 1 shows a longitudinal cross section along the direction of movement of the strip material of a system 100 for continuous heat treatment of moving strip material 102. The strip material 102 can e.g. be paper or board. The system 100 can e.g. be installed downstream of coating equipment for coating paper, to dry and cure the coating. The direction of movement of the strip material through the system is indicated by arrow 103. The system comprises two convective hoods 110, 111 as in the first aspect of the disclosure, transversely installed to the direction of movement of the continuous strip material. The two consecutive convective hoods are separated from each other in the direction of movement of the strip material by at least one radiant emitter 115. FIG. 1 shows two convective hoods 110, 111; however it must be understood that more convective hoods can be installed, with each time radiant emitters transversally installed between two consecutive hoods.

Although FIG. 1 only shows convective hoods and radiant emitters on one side of the strip material, a plurality of convective hoods, with in between radiant emitters, can be installed on both sides of the strip material.

The radiant emitters 115 can comprise gas-fired radiant burners. Next to infrared radiation, the gas-fired radiant burners produce hot combustion gas that is conveyed towards the strip material that is to be heat treated. It is also possible that the radiant emitter comprises electrical radiant emitters. Besides infrared radiation to the strip material, the electrical radiant heaters will heat the gas at the strip material.

The convective hoods 110, 111 comprise blowing nozzles 120, 122 for blowing hot gas against the moving strip for convective heat treatment of the moving strip. The blowing nozzles are installed in an arrangement transverse to the direction of movement of the strip material. The convective hoods further comprise a first transverse suction zone 130, 132 for the suction of hot gas. The first transverse suction zone comprises a first transverse section 140, 142 and a second transverse section 144, 146. The first transverse section and the second transverse section are provided at the same side downstream or upstream of the movement of the strip material from the blowing nozzles. The second transverse section 144, 146 is provided along the line for movement of the continuous strip material between the first transverse section 140, 142 and the blowing nozzles 120, 122. The first transverse section 130, 132 and the second transverse section 144, 146 of the first transverse suction zone 130, 132 will suck hot gas from outside the hood, from at the strip material 102. By their positioning, the first transverse section 130 will suck warmer gas with less moisture content than the second transverse section, as the first transverse section is provided for suction of hot gas from at a first transversal section at the moving strip material; and as the second transverse section is provided for suction of hot gas from at a second transversal section at the moving strip material.

The first transverse section 140, 142 comprises suction openings 150 for suction of hot gas directly from outside the convective hood into the convective hood. The suction openings 150 are in closed gas flow connection to a first manifold 160 for recirculation of at least part, and optionally 100%, of this hot gas to the blowing nozzles 120, 122 for blowing the hot gas onto the continuous strip material 102. To this end, a or each convective hood can comprise an individual fan 162, provided for the suction of hot gas by the suction nozzles 150 of the first transverse section of the first transversal suction zone of a convective hood and for blowing hot gas by the blowing nozzles of the same convective hood.

In the example of FIG. 1, suction openings 150 of the first transverse section 130, 132 of the first transverse suction zone 140, 142 are provided in a segment of the convective hood which tapers between the convective hood and the strip material in the direction of the second transverse section of the suction zone of the convective hood. The taper angle (the angle made with the strip material) is e.g. 45°.

The second transverse section 144, 146 comprises suction openings 152 for suction of hot gas directly from outside the convective hood into the convective hood; these suction openings 152 are in closed gas flow connection to a second manifold 164 for exhausting 100% of this hot gas outside of the convective hood. To this end, the system can comprise a central fan (not shown in FIG. 1) for the suction of hot gas by the suction nozzles of the second transversal sections of the first transversal suction zones of the convective hoods. The central fan is provided for blowing the hot gas sucked by it into piping for exhausting the hot gas out of the system.

In the example of FIG. 1, the suction openings 152 of the second transverse section 144, 146 of the first transverse suction zone 130, 132 are provided such that in the system for continuous heat treatment of moving strip material, the suction openings are located in a plane parallel with the average plane in which the strip material runs through the system.

In the exemplary hoods of FIG. 1, at the other side of the blowing nozzles 120, 122 than where the first transverse suction zone 130, 132 is provided, a second transverse suction zone 166, 168 comprising suction nozzles 170 is provided. The suction nozzles 170 of the second transverse suction zone 166, 168 are in the example all in flow connection with the second manifold 164, for evacuation of the sucked gas out of the system by means of the central fan (not shown in FIG. 1).

In the system of FIG. 1, the first convective hood 110 encountered by the strip material when moving through the system comprises a first transverse suction zone 140 installed in the convective hood in the direction downstream from the blowing nozzles of the movement of the strip material.

The system of FIG. 1 comprises a convective hood 111 in which the first transverse suction zone 142 is provided in the convective hood 111 in the upstream direction of movement of the strip material from the blowing nozzles. When more than two convective hoods are installed at the same side of the strip material to be treated, the convective hoods located further downstream may be positioned according to this configuration.

Figure 2:
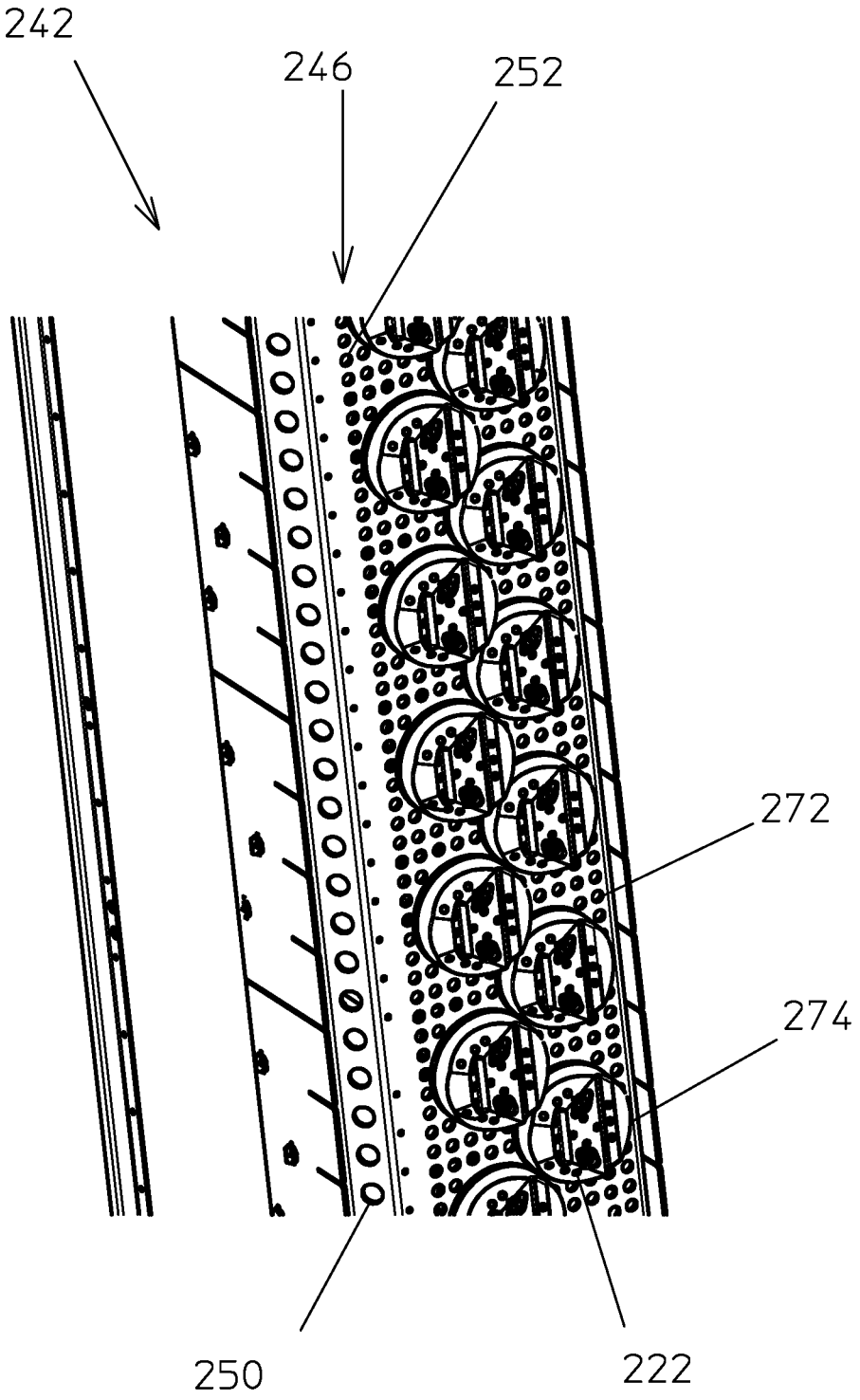
FIG. 2 shows a view of a convective hood according to the first aspect of the disclosure.

FIG. 2 shows a planar view at the suction nozzles and blowing nozzles of the convective hood 111 of FIG. 1. FIG. 2 shows the first transverse suction zone 242 with its suction openings 250 and the second transverse suction zone 246 with its suction openings 252. In between the blowing nozzles 222, additional suction openings 272 are provided for the suction of hot gas. To this end, the blowing nozzles 222 can be provided as blowing openings in blowing heads 274 (shown in 174 in FIG. 1). The blowing heads 174, 274 are each supplied with hot air from a manifold via piping 176 (see FIG. 1). The manifold can be supplied by hot air from the individual fan 162 (of FIG. 1) of the convective hood. In the example, the additional suction openings 272 (FIG. 2) are in flow connection with the second manifold 164 (FIG. 1) for evacuation by the central fan (not shown in the figures) out of the system.

FIG. 1 shows a system for continuous heat treatment of moving strip material installed at one side of the moving strip only. It is possible to install a similar system at the other side of the moving strip as well, in order to treat both sides of the strip material. Although some features, concepts or aspects of the embodiments may be described herein as being a preferred (more or less) arrangement or method, or an advantageous arrangement or method, such description is not intended to suggest that such feature or features are required or necessary unless expressly so stated.

The invention claimed is:

1. A convective hood for transverse installation in a system for continuous heat treatment of moving strip material;

the convective hood comprises blowing nozzles for blowing hot gas against the moving strip in an arrangement transverse to the direction of movement of the strip material; and a first transverse suction zone for the suction of hot gas; wherein the first transverse suction zone comprises a first transverse section and a second transverse section; wherein the first transverse section and the second transverse section are provided at the same side downstream or upstream of the movement of the strip material from the blowing nozzles when the convective hood is installed in a system for continuous heat treatment of moving strip material;

wherein the second transverse section is provided along the line for movement of the continuous strip material between the first transverse section and the blowing nozzles;

wherein the first transverse section comprises suction openings for suction of hot gas directly from outside the convective hood into the convective hood;

wherein said suction openings are in closed gas flow connection to a first manifold for recirculation of at least part of this hot gas to the blowing nozzles for blowing the hot gas onto the continuous strip material;

wherein the second transverse section comprises suction openings for suction of hot gas directly from outside the convective hood into the convective hood;

wherein said suction openings are in closed gas flow connection to a second manifold for exhausting 100% of this hot gas outside of the convective hood, wherein in between the blowing nozzles, additional suction openings are provided for the suction of hot gas, and wherein the additional suction openings are in flow connection with the second manifold for the evacuation out of the convective hood of all gas sucked by the additional suction openings.

2. The convective hood as in claim 1, wherein the first transverse section is provided for suction of hot gas from a first transversal section at the moving strip material; and wherein the second transverse section is provided for suction of hot gas from a second transversal section at the moving strip material.

3. The convective hood as in claim 1, wherein suction openings of the second transverse section of the first transverse suction zone are provided such that when the convective hood is used in a system for continuous heat treatment of moving strip material, the suction openings of the second transverse section are located in a plane parallel with the average plane in which the strip material runs through the system.

4. The convective hood as in claim 1, wherein the convective hood comprises an individual fan;

wherein the individual fan is provided for the suction of hot gas by suction nozzles of the first transverse section of the first transversal suction zone and for blowing hot gas by the blowing nozzles.

5. The convective hood as in claim 1, wherein at the other side of the blowing nozzles than where the first transverse suction zone is provided, a second transverse suction zone comprising suction nozzles is provided;

wherein the suction nozzles of the second transverse suction zone are all in flow connection with the second manifold for evacuation out of the convective hood of all gas sucked by the suction nozzles of the second transverse suction zone.

6. The convective hood as in claim 1, wherein said suction openings of the first transverse section are in closed gas flow connection to a first manifold for recirculation of 100% of this hot gas to the blowing nozzles for blowing the hot gas onto the continuous strip material.

7. A system for continuous heat treatment of moving strip material, comprising a plurality of convective hoods as in claim 1; and at least one radiant emitter transversally installed to the direction of movement for strip material;

wherein two consecutive convective hoods are separated from each other in the direction of movement of the strip material by at least one radiant emitter, wherein at least one of the convective hoods comprises a first transversal suction zone wherein a first transversal section and a second transversal section is provided in the convective hood in the upstream direction of movement of the strip material from the blowing nozzles, wherein the system comprises a central fan for the suction of hot gas by the suction nozzles of the second transversal sections of the first transversal suction zones of the convective hoods; wherein said central fan is provided for blowing the hot gas sucked by it into piping for exhausting the hot gas out of the system.

8. The system as in claim 7, wherein each of the convective hoods comprises an individual fan; wherein the individual fan is provided for the suction of hot gas by the suction nozzles of the first transversal sections of the first transversal suction zone of the convective hood and for blowing hot gas by the blowing nozzles of the same convective hood.

9. The system as in claim 7, wherein the radiant emitter comprises gas-fired radiant burners or wherein the radiant emitter comprises electrical radiant emitters.

* * * * *